United States Patent [19]

Cronenberg et al.

[11] Patent Number: 4,519,165

[45] Date of Patent: May 28, 1985

[54] SEALING DEVICE FOR THE BOTTOM OF A DOOR

[75] Inventors: Dieter-Julius Cronenberg; Jenö Faflek, both of Arnsberg, Fed. Rep. of Germany

[73] Assignee: F. Athmer, Arnsberg, Fed. Rep. of Germany

[21] Appl. No.: 568,452

[22] Filed: Jan. 5, 1984

[51] Int. Cl.[3] ..... E06B 7/20

[52] U.S. Cl. ..... 49/307; 49/306

[58] Field of Search ..... 49/306, 307, 308, 309, 49/310, 311, 312, 313, 314, 315, 303, 316, 317, 321

[56] References Cited

U.S. PATENT DOCUMENTS

| | | | |
|---|---|---|---|
| 1,262,931 | 4/1918 | Dupen | 49/306 |
| 2,066,188 | 12/1936 | Reese | 49/307 |
| 3,199,155 | 8/1965 | Coleman | 49/309 |
| 3,703,788 | 11/1972 | Rivers | 49/307 |
| 4,283,884 | 8/1981 | Dumenil et al. | 49/310 X |

FOREIGN PATENT DOCUMENTS

| | | | |
|---|---|---|---|
| 1187779 | 10/1965 | Fed. Rep. of Germany . | |
| 2458496 | 7/1977 | Fed. Rep. of Germany . | |
| 2329888 | 7/1979 | Fed. Rep. of Germany . | |
| 42145 | 11/1965 | German Democratic Rep. | 49/316 |

*Primary Examiner*—Philip C. Kannan

*Attorney, Agent, or Firm*—John C. Smith, Jr.

[57] ABSTRACT

A sealing device for the bottom of a door comprises a first inverted U-shaped sectional bar (10) which extends along the bottom of a door (1), is firmly secured thereto and contains a control mechanism. A vertically movable second inverted U-shaped sectional bar (14,15) carrying a sealing strip (17) of profiled rubber is accommodated in a lower rectangular chamber formed in the first sectional bar by a horizontal partition wall (11) which extends transversely through the first sectional bar. The web (19) of an inverted substantially U-shaped sealing bar of elastic plastic material is so attached to the upper end portion of the second sectional bar by an adhesive that the depending legs (18) of this sealing bar of elastic plastic material diverge downwardly and engage due to their inherent elasticity with their free longitudinal edges the legs (12) of the first sectional bar so that the sealing effect produced by the sealing strip of profiled rubber is considerably improved since the downwardly diverging legs of the sealing bar of elastic plastic material prevent draft and smoke from passing through the range of tolerance between the first and second sectional bars when the door is closed.

3 Claims, 9 Drawing Figures

SEALING DEVICE FOR THE BOTTOM OF A DOOR

BACKGROUND OF THE INVENTION

This invention is with respect to a sealing device for the bottom of a door, in which a first inverted U-shaped sectional bar forming a rectangular chamber open at its bottom and accommodating an actuating mechanism is firmly secured to the bottom of the door. In the rectangular chamber there is a second sectional bar which likewise forms a rectangular chamber which is open at its bottom. An elastic sealing strip is attached to the second sectional bar which can be raised and lowered by the actuating mechanism in the first sectional bar.

With door sealing devices of this kind the actuating mechanism begins to act when the door is being closed, the second sectional bar being lowered until the elastic sealing strip engages a threshold or floor and a sealing effect between the latter and the door is produced.

A door sealing device of the above-mentioned kind is disclosed in German Pat. No. 24 58 496. According to this patent, the walls of the second sectional bar are guided on the walls of the first sectional bar. It cannot be excluded that when the door is closed draft and in particular smoke pass through the range of tolerance between the first and second sectional bars from one room into another room.

SUMMARY OF THE INVENTION

It is the object of the present invention to avoid the drawbacks of the known sealing devices and to improve their sealing effect considerably.

To attain this object the present invention provides a sealing device for the bottom of a door comprising a first inverted U-shaped sectional bar extending along the bottom of a door and firmly secured thereto, said first sectional bar including a horizontal web and a pair of spaced legs depending therefrom and terminating in free longitudinal edges; a horizontal partition wall connecting the legs with one another at a position spaced from the horizontal web of the first sectional bar and the free longitudinal edges of the legs thereof to provide an upper rectangular chamber and a lower rectangular chamber, the latter being open at its bottom side; a second inverted U-shaped sectional bar including a horizontal web at its upper end portion and a pair of spaced legs depending therefrom and terminating in free longitudinal edges, said second sectional bar being vertically movable in the lower rectangular chamber of the first sectional bar, a gap being left between the immediately neighboring legs and the opposing web portions of the first and second sectional bars; a first elastic sealing means in the form of a sealing strip of profiled rubber mounted in the second sectional bar so as to be vertically movable therewith; second elastic sealing means of elongate plastic material with abilities to slide and consisting at least of at least one sealing strip with an upper and a free lower longitudinal edge portion, the upper longitudinal edge portion being attached to the upper end portion of the second sectional bar and the free lower longitudinal edge portion being arranged to contact due to its inherent elasticity one of the legs of the first sectional bar, thereby to prevent the passing of draft and smoke through the gap between the neighboring legs and the opposing web portions of the first and second sectional bars, and means in the first sectional bar for raising and lowering the sealing strip of profiled rubber together with the second sectional bar upon opening and closing the door.

Since according to the invention the sealing strip of elastic plastic material is fixed on the one hand to the movable second sectional bar and freely engages on the other hand a leg of the first sectional bar, it is ensured that the range of tolerance between the legs of the first sectional bar and the legs of the vertically movable second sectional bar is always and reliably closed by this sealing strip of elastic plastic material when the door is closed. The contact pressure of the sealing strip increases with increasing static or dynamic air current. Any frictional losses are avoided by the ability to slide of the plastic material.

According to a preferred embodiment of the invention, the second elastic sealing means of elongate plastic material is in the form of an inverted substantially U-shaped sealing bar the legs of which avoid at either side of the second sectional bar the passage of draft and smoke through the gap between the first and second sectional bars.

BRIEF DESCRIPTION OF THE DRAWING

An embodiment of the invention will now be described by way of example and with reference to the accompanying drawing in which.

DESCRIPTION OF THE PREFERRED EMBODIMENT

Figure 2:
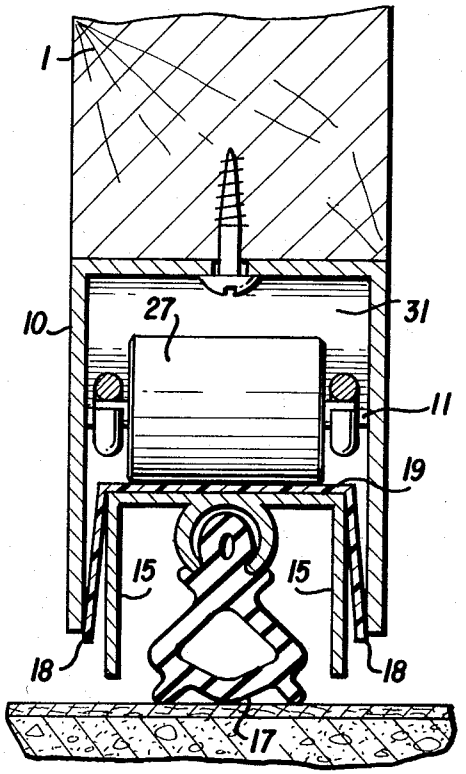
FIG. 2 is a similar view but showing the door in closed position.

As shown in the drawing, a first inverted U-shaped rigid sectional bar 10 of metal, preferably aluminum, is firmly secured to the bottom of a door 1 and includes a horizontal web and a pair of legs 12 which depend from the web and terminate in free longitudinal edges. A horizontal partition wall 11 connects the legs 12 with one another at a position between the web and the free longitudinal edges of the legs 12 and provides an upper rectangular chamber and a lower rectangular chamber, the latter being open at its bottom side.

A second inverted U-shaped sectional bar 14, 15 of metal, preferably aluminum, which includes a horizontal web 14 at its upper end portion and legs 15 depending therefrom and terminating in free longitudinal edges is so arranged in the lower rectangular chamber of the first sectional bar 10 that it is vertically movable therein, a gap being left between the immediately neighboring legs and the opposing web portions of the first and second sectional bars 10 and 14, 15.

A first elastic sealing means in the form of a sealing strip 17 of profiled rubber is held in a groove 16 of the web 14 of the second sectional bar and is vertically movable with said bar.

A second elastic sealing means of elongate plastic material with abilities to slide and consisting at least of an elastic sealing strip having an upper and a free lower longitudinal edge portion has its upper longitudinal edge portion attached to the upper end portion of the second sectional bar 14, 15 by rivets, stitching, an adhesive, nails or screws. The free lower longitudinal edge portion of the elastic sealing strip is arranged to contact due to its inherent elasticity one of the legs 12 of the first sectional bar 10 thereby to prevent draft and smoke to pass through the gap between the immediately neighboring legs and the opposing web portions of the first and second sectional bars 10 and 14, 15.

Figure 1:
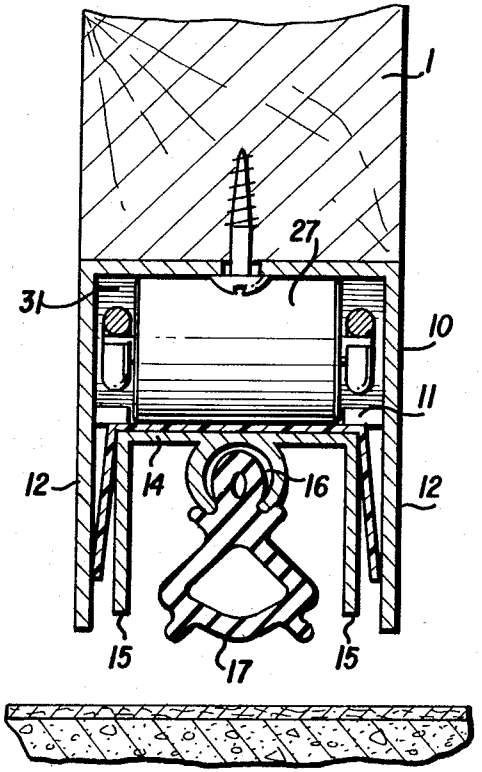
FIG. 1 is a cross section of a door sealing device according to the invention and taken along the line I—I of FIG. 3, the door being shown in open position.
Figure 9:
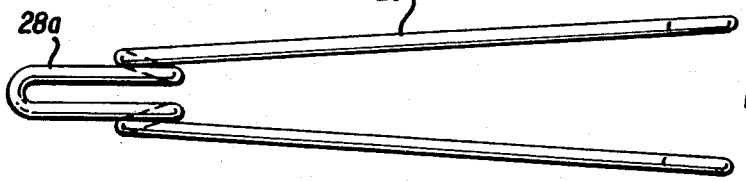
FIG. 9 is an elevational view of a lever-like spring.

FIGS. 1 and 2 show a preferred embodiment in which the second elastic sealing means of elongate plastic material has the form of an inverted substantially U-shaped sealing bar 18, 19. This sealing bar has two elastic sealing strips which form the legs 18 of the said sealing bar and are interconnected at one of their longitudinal edges by a horizontal web 19 attached to the upper end portion of the second sectional bar 14, 15 by an adhesive so that the legs, due to their inherent elasticity, engage with their free edge portions the legs 12 of the first sectional bar 10.

The inverted U-shaped sealing bar of elastic plastic material is simple to produce, easy to install and can also be used in door sealing devices already in service.

The upper rectangular chamber above the horizontal partition wall 11 serves to accommodate an actuating device shown in FIGS. 3–9. Rollers 27, 37 of the actuating device contact the horizontal web 19 of the inverted U-shaped sealing bar. The actuating device begins to function upon closing the door. The second sectional bar 14, 15 is depressed by the rollers 27, 37 into a lower position in which the sealing strip 17 engages a threshold or floor and produces a seal against draft and smoke.

Figure 3:
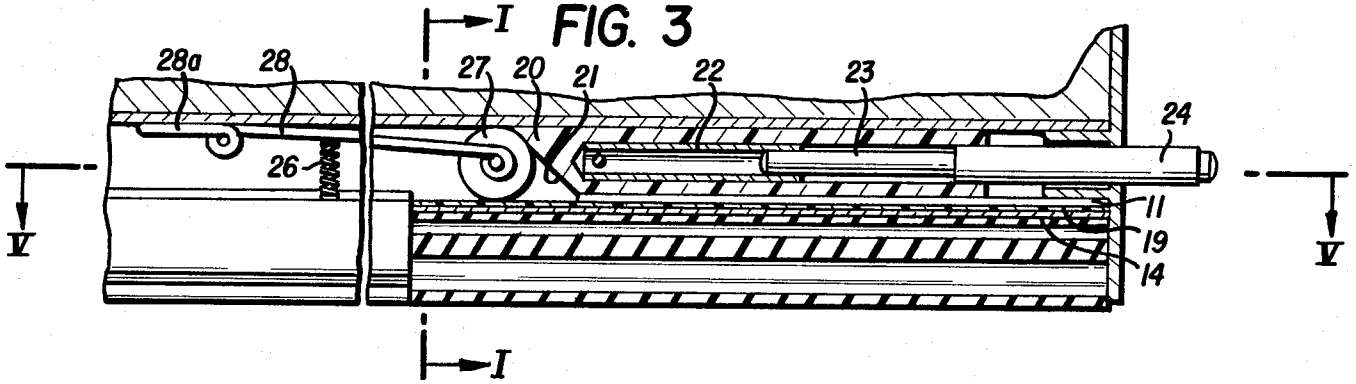
FIG. 3 is a vertical longitudinal sectional view of the door sealing device at the hinge side of the door, with the door being open.

The second U-shaped sectional bar 14, 15 is suspended by means of at least two helical springs 26 so as to be vertically movable, said second U-shaped sectional bar 14, 15 being in the raised position when the door is open as shown in FIG. 3.

The operating linkage at the lock side of the door consists of the operating element 24 projecting from the housing, a rod 23, a sleeve 22 and a slide 20 having an inclined surface 21. The rod 23 is threaded into a thread of the sleeve 22 in order to adjust the operating element 24.

A spring 28 bent from a wire is rigidly attached with one end 28*a* to the upper horizontal web of the first U-shaped rectangular bar 10. At the other end of the spring 28 is formed by two free legs a shaft 29 is provided on which a roller 27 is mounted which engages the top surface of the horizontal web 19 of the inner U-shaped sealing bar.

Figure 4:
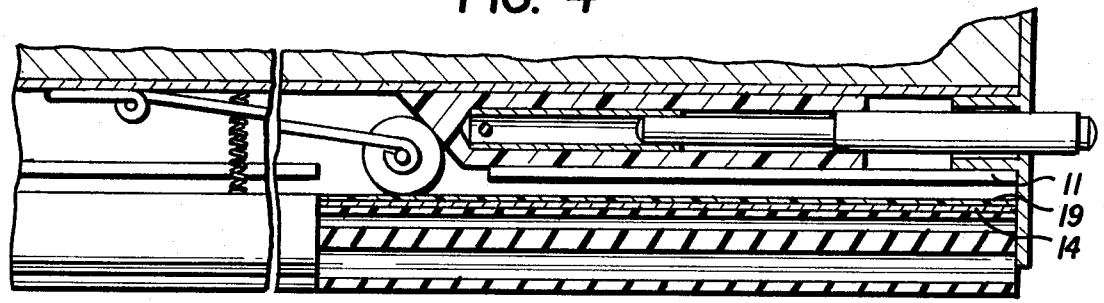
FIG. 4 is a sectional view according to FIG. 3 with the door being closed.
Figure 5:
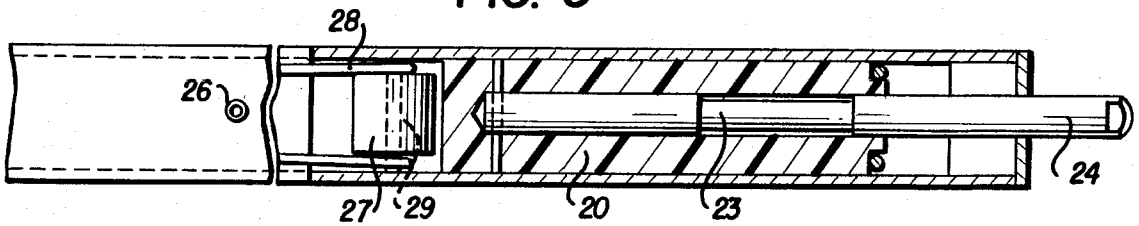
FIG. 5 is a sectional view on the line V—V of FIG. 3.

The function of the operating mechanism can be observed in FIG. 4. When the operating element 24 is pressed during the closing of the door by the door post into the upper chamber of the first U-shaped rectangular bar 10, the roller 27 runs up the inclined surface 21 of the slide 20, the spring 28 being pivoted downwards. The roller 27 presses the second U-shaped rectangular bar 14, 15 and inverted U-shaped sealing bar 18, 19 downwards against the pressure of the helical spring 26. When the operating element 24 becomes free again during opening of the door 1, the roller presses the slide together with the operating linkage outwardly due to the resetting force of the spring 28. The second U-shaped rectangular bar 14, 15 and inverted U-shaped sealing bar 18, 19 is again brought into the open position shown in FIG. 1 by the helical spring 26.

Figure 6:
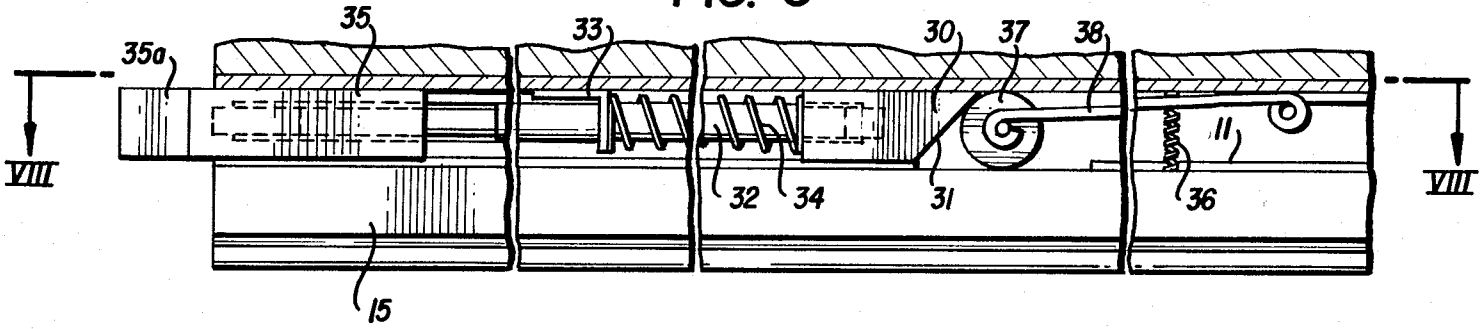
FIG. 6 is a vertical longitudinal sectional view of the door seal at the lock side of the door, with the door being open.
Figure 7:
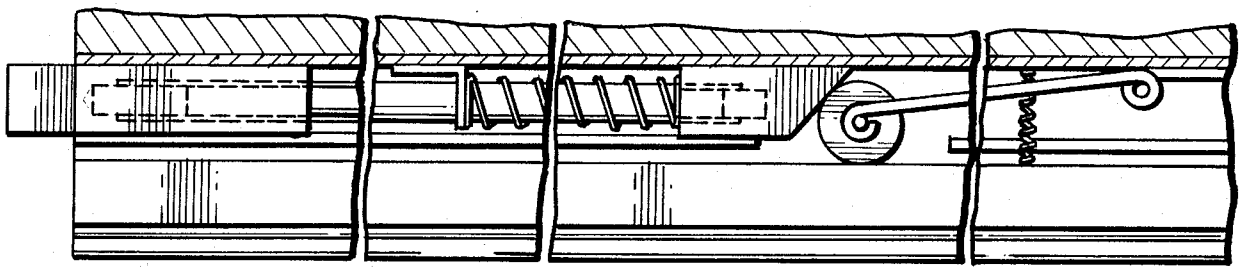
FIG. 7 is a sectional view according to FIG. 6, with the door being closed.
Figure 8:
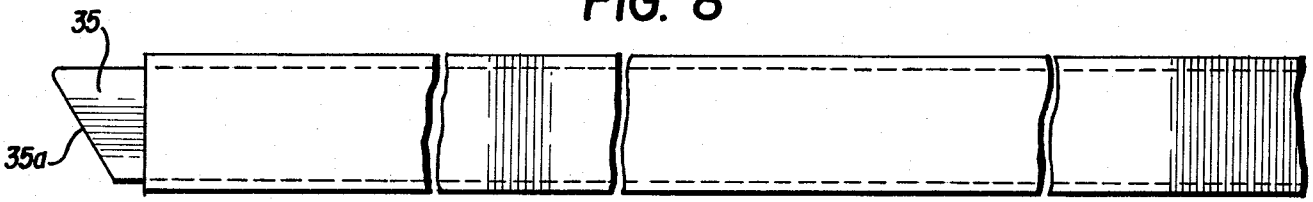
FIG. 8 is a plan taken along the line VIII of FIG. 6.

FIGS. 6, 7 and 8 show the operating mechanism at the lock side of the door. In the upper chamber of the first U-shaped rectangular bar 10, symmetrically to the hinge side of the door, a lever-like spring 38 with a roller 37 is arranged. This end of the second U-shaped rectangular bar 14, 15 is suspended by a helical spring 36. The operating linkage consists of a slide 30 with a wedge-like inclined surface 31, a rod 32 which is mounted in a guide angle 33 and an operating element 35 with an inclined surface 35*a*. The operation is effected in the same manner as in the case of the operating mechanism on the hinge side of the door. Betwen the guide angle 33 and the slide 30 the rod is surrounded by a helical spring 34. Against the pressure of this spring the operating element 35 can be pulled out of the housing to such an extent that the inclined surface 35*a* can be turned over in the event a doorstop is provided on the other side of the door post.

The invention may be embodied in other specific forms without departing from the spirit or essential characteristics thereof. The embodiments are therefore to be considered in all respects as illustrative and not restrictive.

What is claimed is:

1. A sealing device for the bottom of a door comprising (a) a first inverted U-shaped sectional bar for mounting along the bottom of a door, said first sectional bar including a horizontal web and a pair of spaced legs depending therefrom and terminating in free longitudinal edges;

(b) a horizontal partition wall connecting the legs with one another at a position intermediate and spaced from the horizontal web of the first sectional bar and the free ends of the legs thereof to provide an upper rectangular chamber and a lower rectangular chamber, the latter being open at its bottom side;

(c) a second inverted U-shaped sectional bar including a horizontal web at its upper end portion and a pair of spaced legs depending therefrom and terminating in free longitudinal edges to provide a third rectangular chamber open at its bottom side, said second sectional bar being disposed in said lower chamber of said first sectional bar and vertically movable in said lower rectangular chamber, said second sectional bar being of smaller size than said first sectional bar such that a gap is provided between the confronting respective interior and exterior surfaces of said legs of said first and second sectional bars and the confronting respective lower surface of said horizontal partition wall and the upper surface of said web portion of said first and second sectional bars;

(d) a first elastic sealing means in the form of a sealing strip of profile material mounted in said third chamber of said second sectional bar;

(e) second elastic sealing means of plastic material and comprising at least one elongated sealing strip disposed in said gap, a longitudinal portion of said sealing strip, intermediate longitudinal edge portions on opposite sides thereof, extending between said respective lower surface of said horizontal partition wall of said first sectional bar and said upper surface of said web portion of said second sectional bar and being secured to said upper surface of said web portion of said second sectional bar and said longitudinal edge portions of said sealing strip on opposite sides of said central portion thereof extending downwardly between said respective adjacent interior surfaces of said legs of said first sectional bar and said exterior surfaces of said legs of said second sectional bar, said longitudinal edge portions of said sealing strip continuously contacting, due to the inherent elasticity of said sealing strip, the respective inner surfaces of said legs of said sectional bar, thereby to prevent the passing of draft or smoke in either direction through said gap between said respective legs of said first and second sectional bars and said respective partition wall and web portion of said first and second sectional bars; and (f) means in said upper chamber of said first sectional bar for raising and lowering said sealing strip together with said second sectional bar upon opening and closing the door.

2. A sealing device for the bottom of a door as claimed in claim 1, wherein the first inverted U-shaped sectional bar and the second inverted U-shaped sectional bar are made of a rigid metal.

3. A sealing device for the bottom of a door as claimed in claim 1, wherein the first inverted U-shaped sectional bar and the second inverted U-shaped sectional bar are made of aluminum.

* * * * *